US006403162B1

(12) United States Patent
Tokunaga et al.

(10) Patent No.: US 6,403,162 B1
(45) Date of Patent: Jun. 11, 2002

(54) SILICA DISPERSION, METHOD FOR PREPARING THE SAME AND METHOD FOR MAKING INK-JET RECORDING MATERIAL USING THE SAME

(75) Inventors: Yukio Tokunaga; Tetsuya Ashida; Hajime Sugita, all of Tokyo (JP)

(73) Assignee: Mitsubishi Paper Mills Limited, Tokyo (JP)

( * ) Notice: Subject to any disclaimer, the term of this patent is extended or adjusted under 35 U.S.C. 154(b) by 0 days.

(21) Appl. No.: 09/610,485

(22) Filed: Jul. 5, 2000

(30) Foreign Application Priority Data

Jul. 7, 1999 (JP) ..... 11-192669
Sep. 17, 1999 (JP) ..... 11-263089
Jan. 11, 2000 (JP) ..... 2000-006137

(51) Int. Cl.[7] ..... B05D 3/02; B05D 5/04
(52) U.S. Cl. ..... 427/379; 427/382; 427/391
(58) Field of Search ..... 427/391, 379, 427/382

(56) References Cited

U.S. PATENT DOCUMENTS 5,165,973 A 11/1992 Kojima et al. ..... 428/331
6,165,606 A * 12/2000 Kashahara et al. ..... 42/323

FOREIGN PATENT DOCUMENTS

EP 850777 A2 A3 * 7/1998
JP 10217601 8/1998
JP 11020306 1/1999

* cited by examiner

*Primary Examiner*—Erma Cameron
(74) *Attorney, Agent, or Firm*—Manelli Denison & Selter PLLC; Paul E. White, Jr.

(57) ABSTRACT

Disclosed are a method for making an ink-jet recording material which comprises adding silica fine particles having an average primary particle diameter of 50 nm or less to a dispersion medium mainly comprising water containing a cationic polymer having a weight average molecular weight of 100,000 or less and mixing to prepare a slurry of silica fine particles; dispersing the slurry of silica fine particles by a dispersing machine to prepare a dispersion of silica fine particles; mixing the dispersion of silica fine particles with at least a hydrophilic binder to prepare a coating solution for forming an ink-receptive layer; and coating the coating solution for forming an ink-receptive layer on a support and drying, a method for preparing a dispersion of silica fine particles and the silica dispersion.

9 Claims, No Drawings

SILICA DISPERSION, METHOD FOR PREPARING THE SAME AND METHOD FOR MAKING INK-JET RECORDING MATERIAL USING THE SAME

BACKGROUND OF THE INVENTION

1. Field of the Invention

This invention relates to a silica dispersion, a method for preparing the same and a method for making an ink-jet recording material using the same.

2. Prior Art

A dispersion of silica fine particles can be generally prepared by primarily dispersing (premixing) silica fine particles in a dispersing medium (water, an organic solvent or a mixture thereof) to form a slurry of silica fine particles, and then, secondary dispersing the slurry of the silica fine particles by a dispersing machine such as a high-pressure homogenizer, a ball mill, etc.

A silica dispersion can be used as an abrasive for grinding a semiconductor wafer represented by silicon or an insulating layer in the course of producing IC; a hard coating agent for plastics such as eyeglass lenses, etc.; a coating agent for an ink jet recording material or an OHP (overhead projector); and further for an anti-blocking agent for various kinds of films; an adhesive aid for glass fibers, etc.; and a stabilizer for an emulsion, a wax, etc.

On the other hand, an ink-jet recording system has been abruptly spread over various fields. It has been also known to use silica fine particles for an ink-receptive layer of an ink-jet recording material. For example, there have been proposed recording materials obtained by coating silica fine particles and a hydrophilic binder onto a paper support as disclosed in Japanese Provisional Patent Publications No. 51583/1980, No. 157/1981, No. 107879/1982, No. 107880/1982, No. 230787/1984, No. 160277/1987, No. 184879/1987, No. 183382/1987, No. 11877/1989, and the like.

Also, in Japanese Patent Publication No. 56552/1991, Japanese Provisional Patent Publications No. 188287/1990, No. 20306/1998, No. 81064/1998, No. 100397/1998, No. 119423/1998 and No. 203006/1998, there have been disclosed ink-jet recording sheets using synthetic silica fine particles prepared by a gas phase process (hereinafter referred to as "fumed silica"). The fumed silica is ultrafine particles having an average particle diameter of a primary particle of several nm to several tens nm, and has characteristics of easily giving high gloss.

An ink-jet recording material has generally been prepared by coating a coating solution for forming an ink-receptive layer on a support and drying. The coating solution for forming an ink-receptive layer has been known to be prepared by adding a hydrophilic binder (e.g., an aqueous polyvinyl alcohol solution, etc.) or other additives (e.g., a cationic polymer, a hardening agent, a surfactant, etc.) to the above-mentioned dispersion of silica fine particles and dispersing the mixture (see the above-mentioned references).

In the field of the ink-jet recording materials, a photo-like material has been desired in recent years. That is, a recording material having high gloss, high chroma and high ink absorption property has been desired. It is suitable to use an ultrafine silica particle having an average primary particle diameter of 50 nm or less for obtaining characteristics satisfying the above demands, and, for example, fumed silica has preferably been used. However, a dispersion of ultrafine silica particles involves the problems that stability of the dispersion is poor and silica fine particles are liable to be aggregated. As the result, many problems arise that coating failure including cissing, stripe, etc., occur, gloss is lowered, and surface crack occurs.

SUMMARY OF THE INVENTION

Accordingly, an object of the present invention is to provide a method for making an ink-jet recording material which has no coating failure or surface crack, and is excellent in gloss and ink absorption property even when a dispersion of silica fine particles having an average primary particle diameter of 50 nm or less are used.

Another object of the present invention is to provide a silica fine particle dispersion and a method for preparing the same, in which aggregation hardly occurs and excellent in dispersibility of the silica fine particles.

The above objects of the present invention have been achieved by the inventions as mentioned below.

(1) A method for making an ink-jet recording material comprises the steps of:

adding silica fine particles having an average primary particle diameter of 50 nm or less to a dispersion medium mainly comprising water containing a cationic polymer having a weight average molecular weight of 100,000 or less and mixing to prepare a slurry of silica fine particles;

dispersing said slurry of silica fine particles by a dispersing machine to prepare a dispersion of silica fine particles;

mixing said dispersion of silica fine particles with at least a hydrophilic binder to prepare a coating solution for forming an ink-receptive layer; and coating said coating solution for forming an ink-receptive layer onto a support and drying.

(2) A method for preparing a dispersion of silica fine particles comprises the steps of:

adding silica fine particles having an average primary particle diameter of 50 nm or less to a dispersion medium mainly comprising water containing a cationic polymer having a weight average molecular weight of 100,000 or less and mixing to prepare a slurry of silica fine particles; and dispersing said slurry of silica fine particles by a dispersing machine.

(3) A silica dispersion comprises silica fine particles having an average primary particle diameter of 50 nm or less which are being dispersed in a dispersion medium mainly comprising water containing a cationic polymer having a weight average molecular weight of 100,000 or less.

DESCRIPTION OF THE PREFERRED EMBODIMENTS

In the following, the embodiments of the present invention are explained in detail.

In synthesized silica, there are two types of materials, one (precipitated silica) of which is prepared by the wet process and the other (fumed silica) is prepared by the gas phase process. Usual silica fine particles mean those prepared by the wet process in many cases. As the silica prepared by the wet process, there are (1) a silica sol obtained by metathesis of sodium silicate by an acid or passing through an ion exchange resin layer; (2) a colloidal silica obtained by heating and maturing the silica sol of (1); (3) a silica gel obtained by gelling silica sol in which formation conditions thereof are changed whereby primary particles of a silica gel having a diameter of several microns to 10 microns are agglomerated to form three-dimensional secondary particles; and (4) a synthetic silicic acid compound mainly comprising silicic acid obtained by heating silica sol, sodium silicate, sodium aluminate, etc.

A gas phase method for preparing fumed silica is also called to as the drying method contrary to the wet method, and the fumed silica can be generally prepared by a flame hydrolysis method. More specifically, it has been known a method in which silicon tetrachloride is burned with hydrogen and oxygen. In this method, silanes such as methyl trichlorosilane, trichloro-silane, etc., may be used alone in place of silicon tetrachloride or in combination of silicon tetrachloride. The fumed silica is commercially available from Nippon Aerosil K.K. (Japan) as Aerosil (trade name), or K.K. Tokuyama (Japan) as QS Type (trade name), etc.

In the ink-jet recording material according to the present invention, it is preferred to use the fumed silica as compared with that prepared by the wet process since the former easily forms a three-dimensional structure having a high void volume. The reason is not yet clear but can be considered that the density of the silanol groups at the surface thereof would be affected thereto. That is, the fumed silica has a low density of the surface silanol group, and thus, it can be considered that they take a bulky and soft flocculation so that they take a structure having a high void volume.

Among the fumed silica, that having an average primary particle diameter of 30 nm or less is preferred, and particularly preferred is 3 to 15 nm. Also, when they are represented by a specific surface area measured by the BET (Brunauer-Emmett-Teller) method, it is preferably fumed silica having the specific surface area of 200 $m^2/g$ or more, more preferably fumed silica having 250 to 500 $m^2/g$. By using such a fumed silica with an ultrafine particle diameter, an ink-jet recording material having a photo-like gloss, chroma and high ink-absorption property can be realized.

The BET method herein mentioned in the present specification means one of a method for measuring surface area of powder material by a gas phase adsorption method and is a method of obtaining a total surface area possessed by 1 g of a sample, i.e., a specific surface area, from an adsorption isotherm. As an adsorption gas, a nitrogen gas has frequently been used, and a method of measuring an adsorption amount obtained by the change in pressure or a volume of a gas to be adsorbed has most frequently been used. Most frequently used equation for representing isotherm of polymolecular adsorption is a Brunauer-Emmett-Teller equation which is also called to as a BET equation and has widely been used for determining a surface area of a substance to be examined. A specific surface area can be obtained by measuring an adsorption amount based on the BET equation and multiplying the amount with a surface area occupied by the surface of one adsorbed molecule.

As mentioned above, fumed silica is preferably used for an ink-jet recording material of the present invention. However, the fumed silica involves the problem that it is poor in dispersion stability based on its less amount of the silanol group on the surface thereof. In particular, when the average primary particle diameter is small, dispersion stability thereof tends to be worsened.

There is another problem that the fumed silica particles tend to be aggregated when a dispersion of the fumed silica particles is applied to an ink-receptive coating solution. This problem can be considered to be likely caused by mixing a dispersion of silica fine particles and a hydrophilic binder such as polyvinyl alcohol, etc.

Thus, the present invention has been made to solve the above-mentioned problems and the above problems can be solved by the following dispersing method. That is, the method comprises adding silica fine particles having an average primary particle diameter of 50 nm or less in a dispersing medium mainly comprising water containing a cationic polymer having a weight average molecular weight of 100,000 or less and mixing (primary dispersion) to prepare a slurry of silica fine particles, and then, dispersing (secondary dispersion) said slurry of silica fine particles by a dispersing machine.

An important point of the above-mentioned dispersing method is to previously dissolve a cationic polymer having a weight average molecular weight of 100,000 or less in a dispersing medium mainly comprising water, and then, silica fine particles having an average primary particle diameter of 50 nm or less is added to the dispersing medium and mixed (primary dispersion). Here, silica fine particles to be added to the dispersing medium may be in the state of a solid (powder) or may be in the state of a slurry. For preparing a dispersion of silica fine particles with a high concentration, it is preferred to add the silica fine particles in the state of a solid (powder).

When the operation (order of adding materials) is conducted reverse to the above-mentioned operation of the present invention, aggregation of the silica fine particles likely occurs. That is, when an aqueous cationic polymer solution is added to a dispersion of silica fine particles, macroaggregates are likely generated. Also, when a cationic polymer having a weight average molecular weight of exceeding 100,000, aggregation is liable to be caused.

The dispersing medium to be used for preparing a dispersion of silica fine particles according to the present invention mainly comprises water, and a small amount of an organic solvent having a boiling point of 100° C. or less such as a lower alcohol, ethyl acetate, etc., may be contained. In this case, an amount of the organic solvent is preferably 20% by weight or less, more preferably 10% by weight or less based on the total amount of the dispersing medium.

In the present invention, the primary mixing (premixing) can be carried out by using a propeller stirring, turbine type stirring, homomixer type stirring, ultrasonic wave stirring, etc. When the secondary mixing is to be carried out, a high-pressure homogenizer, a ball mill, or the like may be used. As a method of dispersion using the high-pressure homogenizer, the method as disclosed in, for example, Japanese Provisional Patent Publication No. 31064/1998 may be used. A number of times for treating the slurry obtained by the primary dispersion with a high-pressure homogenizer can be selected from the range of one to several ten times.

Next, the cationic polymer having a weight average molecular weight of 100,000 or less to be used in the present invention is to be explained. As the cationic polymer, there may be mentioned, for example, water-soluble cationic polymers having at least one of a quaternary ammonium group, a phosphonium group or an acid adduct of a primary, secondary or tertiary amino group. Moreover, there may be mentioned cationic polymers, for example, polyethyleneimine; polydiallylamine; polyallyl-amine; or those as disclosed in Japanese Provisional Patent Publications No. 20696/1984, No. 33176/1984, No. 33177/1984, No. 155088/1984, No. 11389/1985, No. 49990/1985, No. 83882/1985, No. 109894/1985, No. 198493/1987, No. 49478/1988, No. 115780/1988, No. 280681/1988, No. 40371/1989, No. 234268/1994, No. 125411/1995, No. 193776/1998, and No.

217601/1998, etc. A weight average molecular weight of the cationic polymer to be used in the present invention is preferably 50,000 or less, and the lower limit thereof is preferably about 2,000.

Among the above-mentioned cationic polymers, preferred are those having a quaternary ammonium group, and more preferred are those having a constitutional unit of diallylamine. Particularly preferred are cationic polymers having a constitutional unit of dialkyldiallylamine. The cationic polymers having a constitutional unit of diallylamine are basically represented by the following formulae (1) and (2). These cationic polymers may be copolymers represented by the following formulae (3) and (4).

(1)

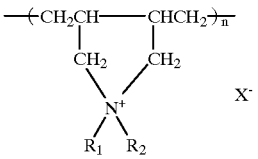

(2)

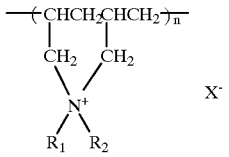

(3)

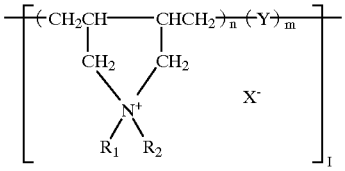

(4)

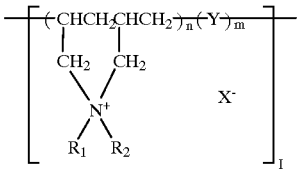

In the above formulae (1) to (4), $R_1$ and $R_2$ each represent a hydrogen atom, an alkyl group having 1 to 4 carbon atoms such as a methyl group, an ethyl group, etc.; a substituted alkyl group having 1 to 4 carbon atoms such as a hydroxyethyl group, etc.; Y represents a radical-polymerizable monomer unit such as sulfonyl, (meth)acrylamide or its derivative, (meth) acrylic acid or (meth)acrylate, etc.; $X^-$ represents an anion; and m, n and 1 are the numbers satisfying the weight average molecular weight of the cationic polymer of the present invention. In the formulae (3) and (4), n/m (weight ratio)=9/1 to 2/8. Here, the term "(meth)acryl" means "acrylic" and "methacryl".

The above-mentioned cationic polymers having a constitutional unit of diallylamine can be obtained by a radical-cyclization polymerization reaction of a diallylamine compound. They are commercially available as Sharol DC series (trade name, available from Daiichi Kogyo Pharmaceutical Co., Ltd., Japan), Jet Fix series (trade name, available from Satoda Kako K.K., Japan), Unisense CP series (trade name, available from Senka K.K., Japan), PAS-A series or PAS-H series (trade name, available from Nitto Boseki Co., Ltd., Japan) products, and the like.

Specific examples of the cationic polymers represented by the formula (3) or (4) may be mentioned, for example, those having a $SO_2$ group as a recurring unit as disclosed in Japanese Provisional Patent Publication No. 83882/1985, copolymers with acrylamide as disclosed in Japanese Provisional Patent Publication No. 9776/1989, and the like.

An amount of the above cationic polymer to be used is preferably 1 to 20% by weight, more preferably 1 to 10% by weight based on the amount of the silica fine particles.

In the dispersion of the silica fine particles of the present invention, dispersion stability can be maintained for a long period of time even when the concentration of the silica fine particles is high as 15% by weight or more.

The dispersion of silica fine particles of the present invention can be used for various uses as mentioned above, and is particularly suitable for use as silica fine particles constituting an ink-receptive layer of an ink-jet recording material.

Next, a method for making an ink-jet recording material using the dispersion of silica fine particles according to the present invention is explained below. In the present invention, an ink-jet recording material can be produced by coating a coating solution for forming an ink-receptive layer (hereinafter simply referred to as "a coating solution") onto a support and drying. In the present invention, the coating solution contains at least the above-mentioned dispersion of silica fine particles and a hydrophilic binder. The hydrophilic binder is usually mixed with the dispersion of silica fine particles in the state of an aqueous solution. In the coating solution, other additives such as a film hardening agent, a surfactant, etc., may be added depending on necessity.

A concentration of the silica fine particles in the dispersion of silica fine particles to be used in the present invention is suitably 10 to 25% by weight, preferably 15% by weight or more. A concentration of the silica fine particles in the coating solution is suitably about 10% by weight or slightly lower than 10% by weight.

In the present invention, the coating solution is applied onto a support so that a coating layer with a thickness of several tens to several hundreds $\mu$m is formed in the wet state, and then, dried. A temperature of the coating solution is generally preferably 30° C. to 45° C.

An amount of the silica fine particles to be contained in the ink-receptive layer in the present invention is preferably in the range of 8 g/m$^2$ or more, more preferably in the range of 10 to 30 g/m$^2$. The ink-receptive layer preferably contains a hydrophilic binder to maintain the characteristic as a film. As the hydrophilic binder, there may be used various known hydrophilic binders, and a hydrophilic binder having high transparency and giving high ink-permeable property is preferably used. For using the hydrophilic binder, it is important that the hydrophilic binder does not clog voids by swelling thereof at the initial stage of ink permeation. Due to the above reason, a hydrophilic binder having a relatively low swelling ability at around a room temperature is preferably used. Particularly preferred hydrophilic binder is a completely or partially saponified polyvinyl alcohol or a cation-modified polyvinyl alcohol.

Among the polyvinyl alcohols, particularly preferred is partially or completely saponified polyvinyl alcohol having a saponification degree of 80% or more. It is also preferred that the polyvinyl alcohol has an average polymerization degree of 500 to 5000.

As the cation-modified polyvinyl alcohol, there may be mentioned a polyvinyl alcohol having a primary, secondary or tertiary amino group or a quaternary ammonium group at the main chain or the side chain thereof as disclosed in Japanese Provisional Patent Publication No. 10483/1986.

Other hydrophilic binder may be used in combination but an amount thereof is preferably 20% by weight or less based on the amount of the polyvinyl alcohol. The hydrophilic binder is preferably added in an amount of 50% by weight or less, more preferably in the range of 10 to 40% by weight based on the amount of the silica fine particles.

The ink-receptive layer of the present invention may preferably contain various kinds of oil drops to improve brittleness of the film. As such oil drops, a hydrophobic organic solvent having a high boiling point and a solubility in water at room temperature of 0.01% by weight or less (e.g., liquid paraffin, dioctyl phthalate, tricresyl phosphate, silicone oil, etc.), polymer particles (e.g., particles obtained by polymerizing at least one of polymerizable monomers such as styrene, butyl acrylate, divinylbenzene, butyl methacrylate, hydroxyethyl methacrylate, etc.) or the like may be used. The above-mentioned oil drops can be preferably used in an amount in the range of 10 to 50% by weight.

To the ink-receptive layer of the present invention, a film-hardening agent may be added for the purpose of improving water resistance and dot reproducing property. Specific examples of the film-hardening agent may include an aldehyde series compound such formaldehyde, glutaraldehyde, etc.; a ketone compound such as diacetyl, chloropentadione, etc.; bis(2-chloroethylurea)-2-hydroxy-4, 6-dichloro-1,3,5-triazine, a compound having a reactive halogen as disclosed in U.S. Pat. No. 3,288,775, divinylsulfone, a compound having a reactive olefin as disclosed in U.S. Pat. No. 3,635,718, a N-methylol compound as disclosed in U.S. Pat. No. 2,732,316, an isocyanate compound as disclosed in U.S. Pat. No. 3,103,437, an aziridine compound as disclosed in U.S. Pat. Nos. 3,017, 280, 2,983,611, etc., a carbodiimide series compound as disclosed in U.S. Pat. No. 3,100,704, an epoxy compound as disclosed in U.S. Pat. No. 3,091,537, a halogen carboxyaldehyde compound such as mucochloric acid, a dioxane derivative such as dihydroxydioxane, an inorganic cross-linking agent such as chromium alum, zirconium sulfate, boric acid and a borate, and they may be used singly or in combination of two or more. The above-mentioned film-hardening agent may be preferably used in an amount of 0.01 to 40% by weight based on the amount of the hydrophilic binder constituting the ink-receptive layer.

To the ink-receptive layer may be added, in addition to the surfactant and film-hardening agent, various kinds of conventionally known additives such as a coloring dye, a coloring pigment, a fixing agent of the ink dye, an UV absorber, an antioxidant, a dispersant of the pigment, a defoaming agent, a leveling agent, an antiseptic agent, a fluorescent brightener, a viscosity stabilizer, a pH controller, etc.

In the present invention, a coating method of the coating solution is not particularly limited, and a coating method conventionally known in the art may be used. For example, there may be mentioned a slide bead system, a curtain system, an extrusion system, an air knife system, a roll coating system, a rod bar coating system, etc.

In the present invention, the ink-receptive layer may be constituted by a single layer or a plural number of layers. In the case of a plural number of layers, the layers may be divided depending on its function. When two or more ink-receptive layers are applied to simultaneously, the solid concentration and the coated amount mean the solid concentration of the whole layers and coated amounts in total, respectively.

In the present invention, it is preferred that a time preferably lapsed for 5 hours or more, more preferably 8 hours or more from the preparation of the dispersion of silica fine particles to coat the coating solution on a support. The term may be longer than the above and may be several days to several tens days. A temperature at the time of lapsing may be preferably-about 10° C. to about 50° C., more preferably about 15° C. to about 40° C.

As the embodiment of the above-mentioned preparation process, the following three methods may be mentioned. (1) A method of making an ink-jet recording layer which comprises preparing a dispersion of silica fine particles (after completion of dispersion), allowing the dispersion to stand for 5 hours or longer, then adding a necessary additive (s) such as a hydrophilic binder, etc. to prepare a coating solution, and coating it onto a support. (2) A method of making the same which comprises preparing a dispersion of silica fine particles, immediately adding a necessary additive (s) such as a hydrophilic binder, etc. to prepare a coating solution, allowing the coating solution to stand for 5 hours or longer, and coating it onto a support. (3) A method of making the same which comprises allowing a dispersion of silica fine particles and a coating solution to stand so that a total time of allowing the dispersion to stand and allowing the coating solution to stand becomes 5 hours or longer, and coating the coating solution onto a support.

Among the above-mentioned methods, the preparation method of (1) is particularly preferred. That is, after preparing a dispersion of silica fine particles, this dispersion of silica fine particles is preferably allowed to stand for 5 hours or longer, more preferably 8 hours or longer, and the an additive(s) such as a hydrophilic binder, etc. is/are added to the dispersion to prepare a coating solution.

As the other preferred embodiment of the preparation method according to the present invention, there may be mentioned a method in which a dispersion of silica fine particles and/or a coating solution is/are subjected to heat treatment at 50° C. or higher after preparation of the dispersion of silica fine particles and before coating the coating solution, and then, the coating solution is applied onto a support. Among them, it is particularly preferred that the dispersion of silica fine particles is subjected to heat treatment preferably in the range of 50° C. to 85° C., more preferably in the range of 60° C. to 80° C. for about 30 minutes or longer (it is no upper limit and more preferably about 1 hour or more and about 10 hours or shorter), and then, a coating solution is prepared and applied onto a support.

As the support to be used in the present invention, a water resistant support is preferred. As the water resistant support, there may be mentioned, for example, a resin film such as a polyester resin including polyethylene terephthalate, polyethylene naphthalate, etc., a diacetate resin, a triacetate resin, an acrylic resin, a polycarbonate resin, a polyvinyl chloride, a polyimide resin, cellophane, celluloid, etc., a polyolefin resin-coated paper in which paper is covered (or laminated) by a polyolefin resin such as polyethylene or polypropylene, etc., and further a glass plate and the like.

These supports may be either transparent or opaque. A thickness of the water resistant support to be used in the present invention is preferably about 50 to 200 $\mu$m or so. Preferred support in the present invention is polyethylene terephthalate or a polyolefin resin-coated paper. In particular, a photo-like recording material can be obtained by using a polyolefin resin-coated paper. In the following, the polyolefin resin-coated paper will be explained in detail.

A base paper constituting the polyolefin resin-coated paper is not particularly limited, and any paper generally used may be employed. More preferably a smooth base paper such as that used as paper for a photographic support may be used. As pulp constituting the base paper, natural pulp, regenerated pulp, synthetic pulp, etc. may be used singly or in combination of two or more. In the base paper, various additives conventionally used in the papermaking industry such as a sizing agent, a strengthening additive of paper, a loading material, an antistatic agent, a fluorescent brightener, a dye, etc. may be formulated.

Moreover, a surface sizing agent, a surface strengthening additive of paper, a fluorescent brightener, an antistatic agent, a dye, an anchoring agent, etc. may be coated on the surface of the sheet.

A thickness of the base paper is not particularly limited, and preferably that having a good surface smoothness prepared by compressing paper during paper-making or after paper-making by applying pressure using a calender, etc. A basis weight thereof is preferably 30 to 250 g/m$^2$.

As a resin of the polyolefin resin-coated paper, a polyolefin resin or a resin which cures by irradiation of electron rays may be used. The polyolefin resin may include a homopolymer of an olefin such as low density polyethylene, high density polyethylene, polypropylene, polybutene, polypentene, etc.; a copolymer comprising two or more olefins such as an ethylene-propylene copolymer, etc.; or a mixture thereof, and these polymers having various densities and melt viscosity indexes may be used singly or in combination of two or more.

Also, to the resin of the polyolefin resin-coated paper, various kinds of additives including a white pigment such as titanium oxide, zinc oxide, talc, calcium carbonate, etc.; an aliphatic amide such as stearic amide, arachidamide, etc.; an aliphatic metal salt such as zinc stearate, calcium stearate, aluminum stearate, magnesium stearate, etc.; an antioxidant such as Irganox 1010, Irganox 1076 (both trade names, available from Ciba Geigy AG), etc.; a blue-color pigment or dye such as cobalt blue, ultramarine blue, cecilian blue, phthalocyanine blue, etc,; a magenta-color pigment or dye such as cobalt violet, fast violet, manganese violet, etc.; a fluorescent brightener, an UV absorber, etc. may be preferably added optionally combining two or more.

The polyolefin resin-coated paper can be prepared, in the case of using a polyolefin resin, by casting a melted resin under heating on a running base paper, which is so-called the extrusion coating method, whereby the both surfaces of the base paper are coated by the resin. In the case of using a resin which cures by irradiation of electronic rays, the resin is coated on a base paper by means of a coater conventionally used such as a gravure coater, a blade coater, etc., and then, electronic rays are irradiated to the resin whereby the resin is cured to coat the base paper. Also, it is preferred to subject an activation treatment to a base paper before coating the resin to the base paper, such as a corona discharge treatment, a flame treatment, etc. A surface of a support to which an ink-receptive layer is applied may have a gloss surface, a matte surface, etc., depending on the uses, and the gloss surface is particularly preferably used. It is not necessarily subjected to resin coating at the back surface of the base paper, but in view of preventing curl, it is preferred to coat the both surfaces of the base paper with the resin. The back surface is generally a non-gloss surface, and the activation treatment such as the corona discharge treatment, the flame treatment, etc. may be applied to the front surface or to the both surfaces of the front and back surfaces depending on the necessity. Also, a thickness of the resin coated layer is not particularly limited, and is generally in the range of 5 to 50 $\mu$m on the front surface or both of the front and back surfaces.

To the support of the present invention, various kinds of back coating layer(s) may be provided for the purpose of providing antistatic property, conveying property, anticurl property, etc. to the support. In the back coating layer, an inorganic antistatic agent, an organic antistatic agent, a hydrophilic binder, a latex, a curing agent, a pigment, a surfactant, etc. may be included in optional combination.

EXAMPLES

The present invention is described in detail by referring to Examples, but the scope of the present invention is not limited by these.

Example 1

A dispersion of silica fine particles was prepared in the manner as mentioned below. In the following, all parts mean part by weight.

| Dispersion A | |
|---|---|
| Water | 430 parts |
| Modified ethanol | 22 parts |
| Cationic polymer (Dimethyldiallyl ammonium chloride homopolymer; weight average molecular weight: 9,000) | 3 parts |
| Fumed silica (Average primary particle diameter: 7 nm; Specific surface area by the BET method: 300 m$^2$/g) | 100 parts |

The cationic polymer was dissolved in a dispersing medium (a mixture of water and modified ethanol), and fumed silica fine particles in powder state were added to the solution and mixed to prepare a slurry of silica fine particles. Next, this slurry of silica fine particles was treated once by a high-pressure homogenizer to prepare a silica dispersion of silica fine particles with a concentration of silica fine particles about 18% by weight.

Dispersion B

In the same manner as in the preparation of Dispersion A except for using the following cationic polymer (weight average molecular weight: about 10,000) represented by the formula (5) in place of the cationic polymer used in Dispersion A, a dispersion was prepared.

(5)

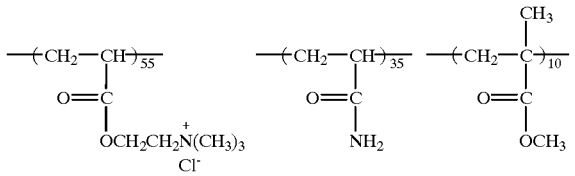

Dispersion C

In the same manner as in the preparation of Dispersion A except for not using the cationic polymer, a dispersion was prepared.

The thus prepared Dispersions A, B and C were stored under a room temperature and allowed to stand, and the states of aggregation and sedimentation were observed. As a result, Dispersion A of the present invention did not cause no aggregation or sedimentation after 2 months, Dispersion B of the present invention slightly aggregated and precipitated after one month, and Dispersion C for comparative purpose caused aggregation and sedimentation after 6 days.

Example 2

On the front surface of a base paper comprising a pulp formulation of LBKP (a bleached craft pulp of hardwood, 50 parts) and LBSP (a sulfuric acid-treated pulp of hardwood, 50 parts) with 120 g/m$^2$ as a support was coated a resin composition comprising a low density polyethylene (70 parts), a high density polyethylene (20 parts) and titanium oxide (10 parts) in an amount of 25 g/m$^2$, and a resin composition comprising a high density polyethylene (50 parts) and a low density polyethylene (50 parts) was coated on the back surface of the same in an amount of 25 g/m$^2$ to prepare a polyolefin resin coated paper.

On the above-mentioned support was coated an ink-receptive layer coating solution having a composition as mentioned below by a slide bead coating device and dried to prepare an ink-jet recording sheet 1. Incidentally, the term "part(s)" means "part(s) by weight".

| Coating solution | |
|---|---|
| Water | 430 parts |
| Modified ethanol | 22 parts |
| Cationic polymer (Dimethyldiallyl ammonium chloride homopolymer; weight average molecular weight: 9,000) | 3 parts |
| Fumed silica (Average primary particle diameter: 7 nm; Specific surface area by the BET method: 300 m$^2$/g) | 100 parts |
| Polyvinyl alcohol (Saponification degree: 88%, Average polymerization degree: 3,500) | 20 parts |
| Boric acid | 6 parts |
| Surfactant | 0.3 part |

The cationic polymer was dissolved in a dispersing medium (a mixture of water and modified ethanol), and fumed silica in powder state were added to the solution and subjected to primary dispersion to prepare a slurry. Next, this slurry was treated once by a high-pressure homogenizer to prepare a dispersion of silica fine particles with a concentration of silica fine particles about 18% by weight. This dispersion was allowed to stand at 20° C. for 6 hours. Then, to the dispersion was added a 8% by weight aqueous polyvinyl alcohol solution in such an amount of 20 parts with a solid content, and boric acid and a surfactant were further added to the mixture and dispersed to prepare a coating solution. This coating solution was so adjusted that the fumed silica became a solid concentration of 8% by weight. The coating solution was applied onto a support within one hour from the preparation thereof at a temperature of 36° C. Incidentally, a coated amount of the fumed silica was so adjusted that became 18 g/m$^2$.

Ink-jet Recording Sheet 2

It was prepared in accordance with the preparation method of Ink-jet recording sheet 1, provided that the cationic polymer was changed to a polydimethyldiallyl ammonium chloride homopolymer (weight average molecular weight: about 30,000).

Ink-jet Recording Sheet 3

It was prepared in accordance with the preparation method of Ink-jet recording sheet 1, provided that the cationic polymer was changed to a copolymerized product of dimethyldiallyl ammonium chloride and sulfur dioxide (1:1, weight average molecular weight: 4,000).

Ink-jet Recording Sheet 4

It was prepared in accordance with the preparation method of Ink-jet recording sheet 1, provided that the cationic polymer was changed to the cationic polymer represented by the above-mentioned formula (5) (weight average molecular weight: about 10,000).

Ink-jet Recording Sheet 5

It was prepared in accordance with the preparation method of Ink-jet recording sheet 1, provided that the cationic polymer was not used.

Ink-jet Recording Sheet 6

It was prepared in accordance with the preparation method of Ink-jet recording sheet 1, provided that the cationic polymer was changed to a polydimethyldiallyl ammonium chloride homopolymer (weight average molecular weight: about 120,000).

Ink-jet Recording Sheet 7

It was prepared in accordance with the preparation method of Ink-jet recording sheet 1, provided that the cationic polymer was changed to the cationic polymer represented by the above-mentioned formula (5) (weight average molecular weight: about 120,000).

Ink-jet Recording Sheet 8

It was prepared in accordance with the preparation method of Ink-jet recording sheet 1, provided that the preparation method of the dispersion of silica fine particles was changed as mentioned below.

Fumed silica in powder state was added to a dispersing medium (a mixture of water and modified ethanol) and subjected to primary dispersion to prepare a slurry. Next, to this slurry was added a 25% by weight aqueous cationic polymer solution and the mixture was treated once by a high-pressure homogenizer to prepare a dispersion of silica fine particles.

With respect to the above-mentioned ink-jet recording materials, coating surface of the ink-receptive layer, glossiness, surface crack and ink absorption property were each evaluated by the following standard. The results are shown in Table 1.

(Evaluation of Coating Surface)

○: No coating failure was admitted.

Δ: Cissing can be slightly admitted.

×: Cissing and light stripe-shaped coating failure can be partially admitted.

(Glossiness)

Gloss at the surface of an ink-jet recording sheet before printing was judged with naked eyes and evaluated by the following four ranks.

○: Gloss is extremely high and good.

○: Gloss is a high level but slightly inferior to ○.

Δ: Gloss is slightly inferior to ○.

×: Gloss is low.

(Surface Crack)

Presence or absence of cracks at the surface of an ink-jet recording sheet before printing was judged with naked eyes and evaluated by the following three ranks.

○: No crack was observed.

Δ: Crack was slightly admitted.

×: Crack was admitted on the whole surface.

(Ink Absorption Property)

Whole surface was solid printed by red-color ink by using PM-770C color printer (trade name, available from Seiko Epson Co., Japan) under normal temperature and normal humidity conditions, and a PPC paper was overlapped with the ink-jet recording sheet with slightly pressurizing immediately after printing, and the degree of an amount of the ink attached to the PPC paper was observed with naked eyes and evaluated by the following standard.

○: No transfer was observed.

Δ: Transfer was slightly admitted.

×: Transfer was admitted remarkably.

TABLE 1

| Sample | Glossiness | Surface crack | Ink absorption property | Coated surface evaluation | Remarks |
|---|---|---|---|---|---|
| Recording sheet 1 | ○ | ○ | ○ | ○ | This invention |
| Recording sheet 2 | ○ | ○ | ○ | ○ | This invention |
| Recording sheet 3 | ○ | ○ | ○ | ○ | This invention |
| Recording sheet 4 | Δ | ○ | ○ | Δ | This invention |
| Recording sheet 5 | X | Δ | Δ | X | Comparative |
| Recording sheet 6 | X | Δ | Δ | X | Comparative |
| Recording sheet 7 | X | Δ | Δ | X | Comparative |
| Recording sheet 8 | X | Δ | Δ | X | Comparative |

As can be clearly seen from the above results, it can be understood that the ink-jet recording sheets of the present invention are all good in an ink-receptive layer coated surface, and satisfy either of the characteristics of glossiness, surface defects of surface crack, etc., or an ink absorption property.

Example 3

Tests were carried out in the same manner as in Example 2 except for changing the support of Example 2 to a polyethylene terephthalate film support (a thickness of 100 μm). As a result, the similar results as in Example 2 could be obtained.

Example 4

In the same manner as in Recording sheets 1, 3 and 4 of Example 2, recording sheets were prepared except that after preparation of a dispersion of silica fine particles, this dispersion was allowed to stand at 20° C. for 3 hours, 6 hours, 12 hours, one day or 5 days, then, an aqueous polyvinyl alcohol solution, boric acid and a surfactant were added and dispersed to prepare coating solutions. The thus prepared recording sheets were evaluated in the same manner as in Example 2. The results are shown in Table 2.

TABLE 2

| Recording sheet | Time lapsed | Glossiness | Surface crack | Ink absorption property | Coated surface evaluation |
|---|---|---|---|---|---|
| 1-1 | 3 hours | Δ | Δ | ○ | Δ |
| 1-2 | 6 hours | ○ | ○ | ○ | ○ |
| 1-3 | 12 hours | ◎ | ○ | ○ | ○ |
| 1-4 | 1 day | ◎ | ○ | ○ | ○ |
| 1-5 | 5 days | ◎ | ○ | ○ | ○ |

TABLE 2-continued

| Recording sheet | Time lapsed | Glossiness | Surface crack | Ink absorption property | Coated surface evaluation |
|---|---|---|---|---|---|
| 3-1 | 3 hours | Δ | Δ | ○ | Δ |
| 3-2 | 6 hours | ○ | ○ | ○ | ○ |
| 3-3 | 12 hours | ◎ | ○ | ○ | ○ |
| 3-4 | 1 day | ◎ | ○ | ○ | ○ |
| 3-5 | 5 days | ◎ | ○ | ○ | ○ |
| 4-1 | 3 hours | Δ | Δ | Δ | Δ |
| 4-2 | 6 hours | Δ | ○ | ○ | Δ |
| 4-3 | 12 hours | ○ | ○ | ○ | ○ |
| 4-4 | 1 day | ○ | ○ | ○ | ○ |
| 4-5 | 5 days | ○ | ○ | ○ | ○ |

As can be seen from the above results, it can be understood that more excellent results can be obtained by allowing the dispersion of silica fine particles to stand for 5 hours or longer.

Example 5

In the same manner as in the preparation of Recording sheets 1-1 to 1-5 of Example 4, Recording sheets 1-1A to 1-5A were prepared except that each of the coating solutions was prepared by subjecting the respective dispersions to heat treatment at 70° C. for 90 minutes after the preparation of the dispersions of silica fine particles. The thus prepared recording sheets were evaluated in the same manner as in Example 2. The results are shown in Table 3.

TABLE 3

| Recording sheet | Time lapsed | Heat treatment | Glossiness | Surface crack | Ink absorption property | Coated surface evaluation |
|---|---|---|---|---|---|---|
| 1-1A | 3 hours | Done | ○ | ○ | ○ | ○ |
| 1-2A | 6 hours | Done | ◎ | ○ | ○ | ○ |
| 1-3A | 12 hours | Done | ◎ | ○ | ○ | ○ |
| 1-4A | 1 day | Done | ◎ | ○ | ○ | ○ |
| 1-5A | 5 days | Done | ◎ | ○ | ○ | ○ |

As can be seen from the above results, it can be understood that more excellent results can be obtained by subjecting the dispersion of silica fine particles to heat treatment.

What is claimed is:

1. A method for making an ink-jet recording material comprising the steps of:

adding fumed silica fine particles having an average primary particle diameter of 50 nm or less to a dispersion medium mainly comprising water containing a cationic polymer having a weight average molecular weight of 100,000 or less and mixing to prepare a slurry of fumed silica fine particles;

dispersing said slurry of fumed silica fine particles by a dispersing machine to prepare a dispersion of fumed silica fine particles;

mixing said dispersion of fumed silica fine particles with at least a hydrophilic binder to prepare a coating solution for forming an ink-receptive layer; and coating said coating solution for forming an ink-receptive layer onto a support and drying.

2. The method for making an ink-jet recording material according to claim 1, wherein the cationic polymer has a weight average molecular weight of 2,000 to 50,000.

3. The method for making an ink-jet recording material according to claim 1, wherein the cationic polymer is a cationic polymer having a diallyl amine structure as a constitutional unit.

4. The method for making an ink-jet recording material according to claim 1, wherein the fumed silica fine particles are prepared by a gas phase process having an average primary particle diameter of 3 to 15 nm.

5. The method for making an ink-jet recording material according to claim 1, wherein a time from the preparation of the dispersion of fumed silica fine particles to the time of coating the coating solution for forming an ink-receptive layer is at least 5 hours.

6. The method for making an ink-jet recording material according to claim 1, wherein a step of heat treatment at 50° C. or higher is carried out after the step of dispersing said slurry of fumed silica fine particles and before the step of coating said coating solution.

7. A method for making a coating solution for forming an ink-receptive layer to be used for the process according to claim 1, which comprises the steps of:

adding fumed silica fine particles having an average primary particle diameter of 50 nm or less to a dispersion medium mainly comprising water containing a cationic polymer having a weight average molecular weight of 100,000 or less and mixing to prepare a slurry of fumed silica fine particles; and dispersing said slurry of fumed silica fine particles by a dispersing machine to prepare a dispersion of fumed silica fine particles; and mixing said dispersion of fumed silica fine particles with at least a hydrophilic binder.

8. The method for making an ink-jet recording material according to claim 1, wherein the coating solution is prepared by preparing a dispersion of fumed silica fine particles, allowing the dispersion to stand for 5 hours or longer, and mixing the dispersion with at least a hydrophilic binder.

9. The method for making an ink-jet recording material according to claim 1, wherein the coating solution is prepared by preparing a dispersion of fumed silica fine particles, subjecting the dispersion to heat treatment at 50° C. or higher, and mixing the dispersion with at least a hydrophilic binder.

* * * * *